US011458515B2

(12) United States Patent
Harrington

(10) Patent No.: US 11,458,515 B2
(45) Date of Patent: Oct. 4, 2022

(54) CLEANING DEVICES FOR CLEANING OF DIFFICULT TO REACH LOCATIONS

(71) Applicant: Unger Marketing International, LLC, Bridgeport, CT (US)

(72) Inventor: William Harrington, Charlestown, RI (US)

(73) Assignee: UNGER MARKETING INTERNATIONAL, LLC, Bridgeport, CT (US)

( * ) Notice: Subject to any disclaimer, the term of this patent is extended or adjusted under 35 U.S.C. 154(b) by 281 days.

(21) Appl. No.: 15/879,378

(22) Filed: Jan. 24, 2018

(65) Prior Publication Data

US 2018/0221924 A1 Aug. 9, 2018

Related U.S. Application Data

(60) Provisional application No. 62/451,044, filed on Jan. 26, 2017.

(51) Int. Cl.

| | |
|---|---|
| ***B08B 9/043*** | (2006.01) |
| ***A47L 13/16*** | (2006.01) |
| ***A47L 13/44*** | (2006.01) |
| ***A47L 13/46*** | (2006.01) |

(52) U.S. Cl.

CPC ..... *B08B 9/0436* (2013.01); *A47L 13/16* (2013.01); *A47L 13/44* (2013.01); *A47L 13/46* (2013.01)

(58) Field of Classification Search

CPC ..... B08B 9/0436; A47L 13/46; A47L 13/44; A47L 13/16

See application file for complete search history.

(56) References Cited

U.S. PATENT DOCUMENTS

| | | | |
|---|---|---|---|
| 1,360,615 | A | 11/1920 | Bolard |
| 1,694,636 | A | 12/1928 | Barker |
| 1,977,180 | A | 10/1934 | Forbes |
| 1,982,910 | A | 12/1934 | Forbes et al. |
| 2,998,614 | A | 9/1961 | Winch |
| 3,058,139 | A | 10/1962 | Dryden |
| 3,332,103 | A | 7/1967 | Case |
| 3,407,424 | A | 10/1968 | Lanzarone et al. |
| 4,328,604 | A | 5/1982 | Adams |
| 4,520,526 | A | 6/1985 | Peters |
| D296,271 | S | 6/1988 | Kobayashi |

(Continued)

FOREIGN PATENT DOCUMENTS

| | | |
|---|---|---|
| CA | 2519035 A1 | 10/2006 |
| DE | 1986144 | 5/1968 |

(Continued)

OTHER PUBLICATIONS

European Search Report for Application No. 18153646.7-1018/3366184 dated Aug. 1, 2018; 7 pgs.

(Continued)

*Primary Examiner* — Alexander Markoff
(74) *Attorney, Agent, or Firm* — Cantor Colburn LLP

(57) ABSTRACT

A cleaning device is provided that includes a handle and a cleaning implement depending from the handle. The cleaning implement has a wiper including a plurality of ridges and a flexible region. The plurality of ridges provide a plurality of cleaning edges to the wiper and the flexible region secures the wiper to the handle.

9 Claims, 15 Drawing Sheets

(56) References Cited

U.S. PATENT DOCUMENTS 4,794,663 A 1/1989 Vosbikian
4,829,621 A 5/1989 Phenegar
5,158,532 A 10/1992 Peng
5,315,732 A 5/1994 Huefner
5,333,345 A 8/1994 O'Donnell
5,400,457 A 3/1995 Ridgley
5,491,863 A 2/1996 Dunn
5,598,596 A * 2/1997 Jones ..... A47L 13/16 15/1.52
5,630,244 A 5/1997 Chang
5,709,003 A 1/1998 Batch
5,878,459 A 3/1999 McParland
5,967,152 A 10/1999 Rimkus
6,015,293 A 1/2000 Rimkus
6,132,126 A 10/2000 Sheffler
6,134,738 A 10/2000 Weber
6,154,913 A 12/2000 Burton
6,192,525 B1 2/2001 Tash
6,237,182 B1 5/2001 Cassar
6,279,189 B1 8/2001 Cassar
6,530,707 B1 3/2003 Byrne
6,546,588 B1 4/2003 Black
6,948,209 B2 9/2005 Chan
6,990,706 B2 1/2006 Broecker et al.
7,017,222 B2 3/2006 Dunn
7,213,292 B1 5/2007 Tucker
7,334,286 B2 2/2008 Kayser
7,344,327 B2 3/2008 Gueret
7,356,869 B2 4/2008 Knopow
D579,615 S * 10/2008 Ames ..... D32/52
7,640,617 B2 1/2010 Kennedy et al.
7,716,777 B2 * 5/2010 Lee ..... A47L 13/20 15/229.3
7,745,354 B2 * 6/2010 Tsuchiya ..... A01N 25/34 15/1.52
7,784,141 B2 8/2010 Knopow
8,046,865 B2 11/2011 Knopow
8,123,712 B2 2/2012 Julius
8,136,196 B2 3/2012 Dingert
D663,530 S 7/2012 Duwa
D683,544 S 6/2013 Duwa
8,984,701 B2 3/2015 Tussy
9,066,583 B2 6/2015 Kayser
9,167,882 B2 10/2015 Stefanson
9,339,104 B2 5/2016 O'Neill
D851,408 S * 6/2019 Harrington ..... D4/136
D882,963 S * 5/2020 Harrington ..... D4/137
D909,069 S * 2/2021 Harrington ..... D4/137
2001/0047556 A1 12/2001 Weihrauch
2002/0148061 A1 * 10/2002 Tanaka ..... A47L 13/20 15/229.3
2004/0011382 A1 * 1/2004 Kingry ..... A47L 13/256 134/6
2004/0143923 A1 7/2004 Bensussan
2004/0177863 A1 9/2004 McKay
2005/0144749 A1 * 7/2005 Yamada ..... A46B 7/04 15/226
2006/0070198 A1 4/2006 DeRoma
2006/0234899 A1 * 10/2006 Nekmard ..... A47L 13/16 510/439
2007/0020020 A1 * 1/2007 Bobrosky ..... A47L 9/04 401/9
2007/0028409 A1 * 2/2007 Yamada ..... A47L 13/20 15/226
2008/0028555 A1 2/2008 Petner
2008/0028560 A1 * 2/2008 Policicchio ..... A47L 13/38 15/229.3
2008/0032577 A1 * 2/2008 Policicchio ..... A47L 13/38 442/123
2010/0115722 A1 5/2010 Malloy
2011/0107551 A1 5/2011 Cassar
2011/0226638 A1 * 9/2011 Hoadley ..... A46B 5/0075 206/229
2012/0183344 A1 7/2012 Habinger
2013/0298342 A1 11/2013 Cassar
2014/0099154 A1 4/2014 O'Neill
2014/0137352 A1 5/2014 Golla
2016/0029859 A1 2/2016 Harrington
2016/0249733 A1 9/2016 Tebbe et al.

FOREIGN PATENT DOCUMENTS

DE 1995617 10/1968
DE 4435888 4/1996
DE 202013005066 8/2013
FR 2371178 A1 6/1978
GB 418871 A 11/1934
GB 651508 A 4/1951
JP 2257904 A 10/1990
WO 2013063568 5/2013
WO 2013063568 A1 5/2013

OTHER PUBLICATIONS

European Search Report for Application No. 18153649.1-1018 dated Jun. 8, 2018; 8 pgs.
U.S. Final Office Action; U.S. Appl. No. 15/879,373, filed Jan. 24, 2018; dated Feb. 11, 2020; 16 pages.
European Office Action; International Application No. 18153646.7-1016; International Filing Date: Jan. 26, 2018; dated Aug. 20, 2020; 5 pages.
European Office Action; International Application No. 18153649.1-1016; International Filing Date: Jan. 26, 2018; dated Aug. 21, 2020; 6 pages.
U.S. Final Office Action; U.S. Appl. No. 15/879,373, filed Jan. 24, 2018; dated Oct. 19, 2020; 8 pages.

* cited by examiner

CLEANING DEVICES FOR CLEANING OF DIFFICULT TO REACH LOCATIONS

CROSS REFERENCE TO RELATED APPLICATIONS

This application claims the benefit of U.S. Provisional Application No. 62/451,044 filed on Jan. 26, 2017, the entire contents of which are incorporated by reference. This application also incorporates by reference the entire contents of U.S. application Ser. No. 14/791,531 filed Jul. 5, 2015.

BACKGROUND

1. Field of the Invention

The present disclosure is related to cleaning devices. More particularly, the present disclosure is related to cleaning devices allowing for cleaning of difficult to reach locations.

2. Description of Related Art

Cleaning devices that have handles or pole (hereinafter "handles") and cleaning implements are known. These cleaning implements can include, but are not limited to, dusting devices, wiping devices, brushing devices, mopping devices, scraping devices, and others.

In some cleaning applications, it is desired for the cleaning device to have one or more portions resiliently flex or bend (hereinafter "flex") to allow cleaning in hard to reach places such as, but not limited to, the inside of food and/or drink dispensing equipment.

Accordingly, it has been determined by the present disclosure that there is a continuing need for new and improved cleaning devices.

SUMMARY

A cleaning device is provided that includes a handle and a cleaning implement depending from the handle. The cleaning implement has a wiper including a plurality of ridges and a flexible region. The plurality of ridges provide a plurality of cleaning edges to the wiper and the flexible region secures the wiper to the handle.

In some embodiments either alone or together with any one or more of the aforementioned and/or after-mentioned embodiments, the wiper is a flexible wiper.

In some embodiments either alone or together with any one or more of the aforementioned and/or after-mentioned embodiments, the handle has a longitudinal axis and the plurality of ridges allow the wiper to flex in directions perpendicular to the longitudinal axis, to resiliently elongate along the longitudinal axis, to resiliently compress along the longitudinal axis, and any combinations thereof.

In some embodiments either alone or together with any one or more of the aforementioned and/or after-mentioned embodiments, the plurality of ridges depend from a central spine. The flexible region securing the central spine to the handle.

In some embodiments either alone or together with any one or more of the aforementioned and/or after-mentioned embodiments, the spine is flexible.

In some embodiments either alone or together with any one or more of the aforementioned and/or after-mentioned embodiments, the cleaning implement further includes a cleaning cloth disposed on the wiper.

In some embodiments either alone or together with any one or more of the aforementioned and/or after-mentioned embodiments, the cleaning cloth is made of a material selected from the group consisting of nonwoven material, cotton, polyester, nylon, microfiber, twisted loop microfiber, and any combinations thereof.

In some embodiments either alone or together with any one or more of the aforementioned and/or after-mentioned embodiments, the wiper further includes one or more features that interact with corresponding features on the cleaning cloth to secure the cleaning cloth to the wiper.

In some embodiments either alone or together with any one or more of the aforementioned and/or after-mentioned embodiments, the cleaning cloth includes a feature formed in a direction along a longitudinal axis of the handle or perpendicular to the longitudinal axis of the handle, the feature being configured to removably secure the cleaning cloth to the wiper.

In some embodiments either alone or together with any one or more of the aforementioned and/or after-mentioned embodiments, the wiper is a unitary molded polymer member.

In some embodiments either alone or together with any one or more of the aforementioned and/or after-mentioned embodiments, the unitary molded polymer member is a material selected from the group consisting of silicone, urethane, thermoplastic elastomer (TPE), thermoplastic rubber (TPR), the material having a Shore A durometer of between 20 and 100.

In some embodiments either alone or together with any one or more of the aforementioned and/or after-mentioned embodiments, the plurality of ridges form of a hollow member that terminates at the flexible region at one end and has an open end at the opposite end.

In some embodiments either alone or together with any one or more of the aforementioned and/or after-mentioned embodiments, the open end is configured to provide at least one cleaning edge in an internal surface for cleaning.

In some embodiments either alone or together with any one or more of the aforementioned and/or after-mentioned embodiments, the cleaning implement further includes a cleaning cloth disposed on the wiper.

In some embodiments either alone or together with any one or more of the aforementioned and/or after-mentioned embodiments, the cleaning cloth includes a region extending into the open end to cover the interior surface.

A cleaning device is also provided that includes a cleaning cloth, a handle, and a cleaning implement depending from the handle. The cleaning implement includes a wiper in the form of a hollow member that terminates at a flexible region at one end and has an open end at the opposite end. The flexible region flexibly securing the wiper to the handle. The cleaning cloth is removably disposed on the wiper so that the cleaning cloth covers an external region of the wiper and so that a region of the cleaning cloth extends into the open end to an internal region of the hollow member.

In some embodiments either alone or together with any one or more of the aforementioned and/or after-mentioned embodiments, the wiper includes a plurality of ridges that define a plurality of cleaning faces/edges on the external region and/or the internal region.

In some embodiments either alone or together with any one or more of the aforementioned and/or after-mentioned embodiments, the handle has a longitudinal axis, the wiper being flexible and being configured so that the plurality of ridges allow the wiper to resiliently flex in directions perpendicular to the longitudinal axis, resiliently compress in directions along the longitudinal axis, resiliently elongate in directions along the longitudinal axis, and any combinations thereof.

In some embodiments either alone or together with any one or more of the aforementioned and/or after-mentioned embodiments, the wiper is a unitary molded polymer member comprising molded silicone or urethane having a Shore A durometer of between 20 and 100.

In some embodiments either alone or together with any one or more of the aforementioned and/or after-mentioned embodiments, the cleaning cloth has a cleaning material at both the exterior and interior regions.

In some embodiments either alone or together with any one or more of the aforementioned and/or after-mentioned embodiments, the cleaning cloth has a mesh at the exterior region and a cleaning material at the interior region.

A method of cleaning a channel having an area at a remote end is provided. The method includes the steps of: holding a handle of a cleaning device having a cleaning implement including a cleaning cloth and a wiper, the wiper having a flexible region securing the wiper to the handle, the wiper being in the form of a hollow member with an open end opposite the flexible region, the cleaning cloth being disposed on the wiper so that the cleaning cloth covers an external region of the wiper and so that a region of the cleaning cloth extends into an internal region at the open end; inserting the cleaning implement into the channel until the region of the cleaning cloth in the open end of the wiper contacts the area at the remote end; and moving the handle to move the cleaning implement to clean the area.

In some embodiments either alone or together with any one or more of the aforementioned and/or after-mentioned embodiments, the wiper having the cleaning cloth thereon has an external dimension that correspond to an internal dimension of the channel so that the step of inserting the cleaning implement comprises contacting the internal dimension of the channel with the cleaning cloth.

The above-described and other features and advantages of the present disclosure will be appreciated and understood by those skilled in the art from the following detailed description, drawings, and appended claims.

DETAILED DESCRIPTION

Figure 1:
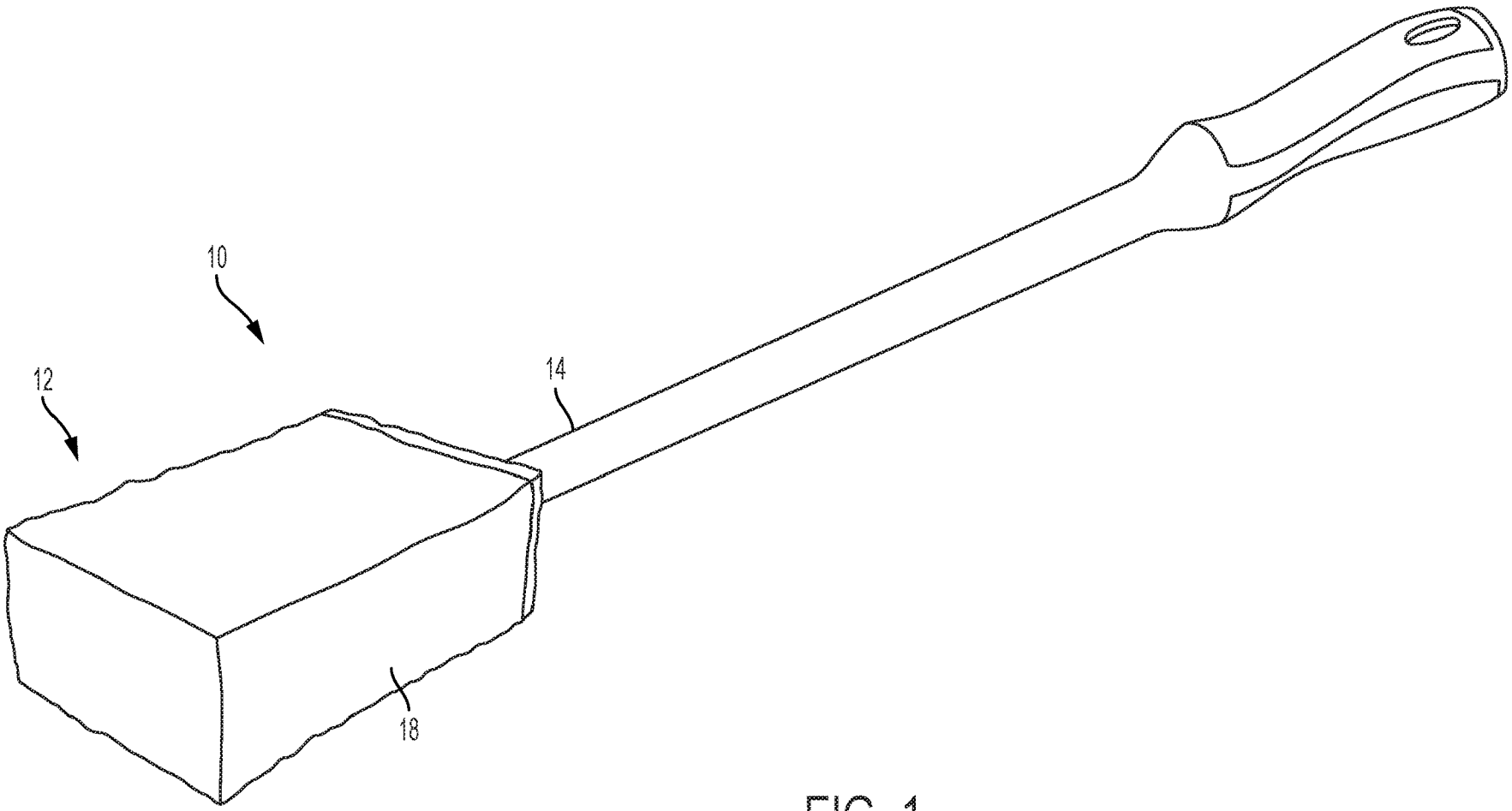
FIG. 1 is perspective view of a cleaning device according to the present disclosure.
Figure 2:
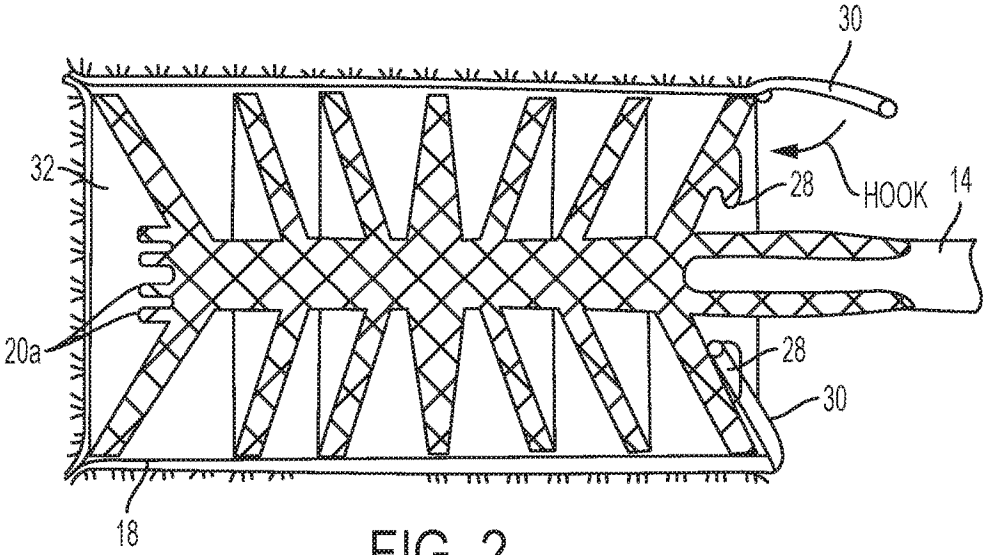
FIGS. 2 and 3 are partial sectional views of the cleaning device of FIG. 1 in various states of flexion.
Figure 3:
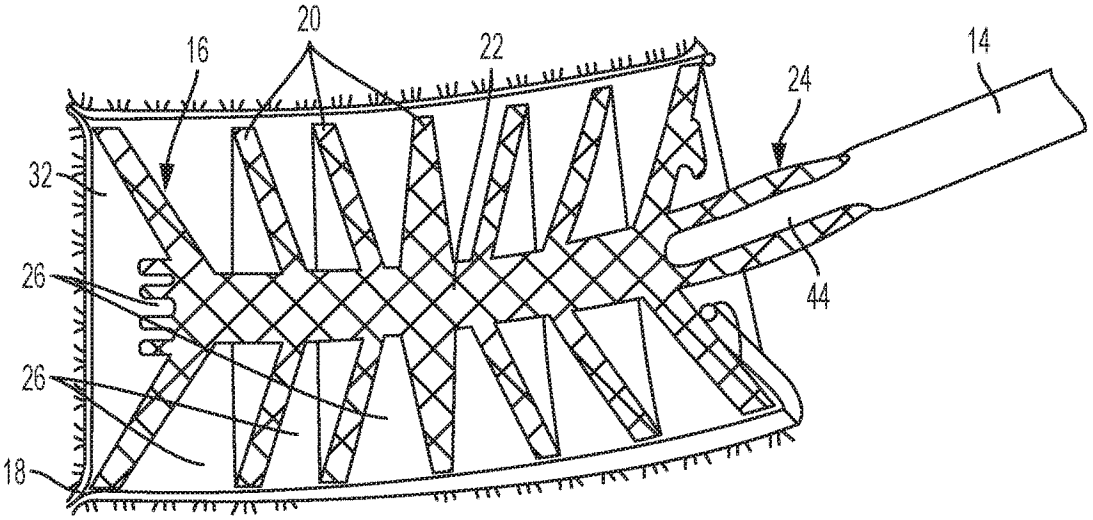

Referring now to the drawings and in particular to FIGS. 1-3, an exemplary embodiment of a cleaning device according to the present disclosure is shown and is referred to by reference numeral 10.

Device 10 includes a cleaning implement 12 and handle 14. Cleaning implement 12 includes a wiper 16 that, in some embodiments is used in combination with a cleaning cloth 18. Advantageously, device 10 is configured to allow for cleaning of hard to reach locations by way of wiper 16, which in some embodiments is configured to flex as shown in FIGS. 2-3.

Wiper 16 can include a plurality of ridges 20 that create multiple contact surfaces with the surface being cleaned. The contact surfaces, preferably, include a plurality of cleaning faces/edges defined by ridges 20 to enhance the cleaning efficiency of device 10.

Ridges 20 depend from a central spine 22 where the spine can include a flexible region 24 at handle 14.

For example, region 24 can be substantially as disclosed in Applicant's U.S. application Ser. No. 14/791,531, which is incorporated by reference herein—where the neck provides a first level of flexion in a first orientation, but a second, lower level of flexion in a second orientation. As used herein, the term "orientation" shall mean a degree of rotation about a longitudinal axis of handle 14. However, it is also contemplated by the present disclosure for region 24 to provide equal levels of flexion in all orientations. Here, device 10 is particularly configured to be rotated while in a flexed position, allowing region 24 to act as a universal joint during rotation.

The terms "rigid", "inflexible", "flexible", and the like are obviously terms of degree and are used herein to describe the general properties region 24.

In embodiments where region 24 allows flexion, upon application of sufficient force, in the first orientation, but resists flexion in the second orientation, the region can have a stiffness ratio of flexion in the first orientation to flexion the second orientation of between 2:1 to 100:1, more preferably between 5:1 and 50:1, with about 10:1 being most preferred.

Region 24 is, preferably, molded as a single unitary member with wiper 16 and can be secured to a rib 44 of handle 14. Rib 44 can be a portion of handle 14 that has a reduced cross section than remaining regions of the handle, allowing for flexion of the rib. Region 24 can, in some embodiments, completely encase rib 44, while in other embodiments can be disposed only on sides of the rib.

Rib 44 can have any desired cross section. For example, in some embodiments rib 44 has a rectangular cross section that allows for the first and second levels of flexion depending on the orientation, while in other embodiments the rib has a circular cross section that allows for equal levels of flexion regardless of the orientation.

Advantageously, region 24 provides, at least in part, elastomeric or resilient properties to wiper 16. Accordingly, the degree of flexibility of region 24 can be calibrated or tuned by adjusting the dimensions, shape, features, and materials of region 24, rib 44, and wiper.

It is contemplated by the present disclosure for region 24 to, in some embodiments, flex with respect to the axis of handle 14 by up to 90 degrees, more preferably up to 45 degrees. Additionally, it is contemplated by the present disclosure for region 24 to, in some embodiments, flex upon the application of a torque of between 2 and 50 inch pounds, more preferably between 5 and 10 inch pounds.

In some embodiments, ridges 20 and/or spine 22 can be flexible to provide further ability to allow for cleaning of hard to reach locations.

In the illustrated embodiment, at least some ridges 20 are illustrated with a positive angle with respect to a longitudinal axis of handle 14, others are illustrated with a negative angle, and still another is illustrated being perpendicular to the axis. However, it is contemplated by the present disclosure for ridges 20 to have any desired angle—and for the ridges to all have the same angle or different angles. Additionally, ridges 20 can be configured to flex and/or deform as desired.

In other embodiments, wiper 16 terminates at an open end 32, which in some embodiments has one or more ridges 20*a* therein. Open end 32 allows wiper 16 to not only use its exterior surface to clean, but also allows access to the internal surfaces 34 of the wiper—namely internal surfaces of ridges 20*a* as seen in FIGS. 2-3. In this manner, wiper 16 is configured to clean three-dimensional internal surfaces of equipment—such food and/or beverage dispensing equipment.

Figure 4:
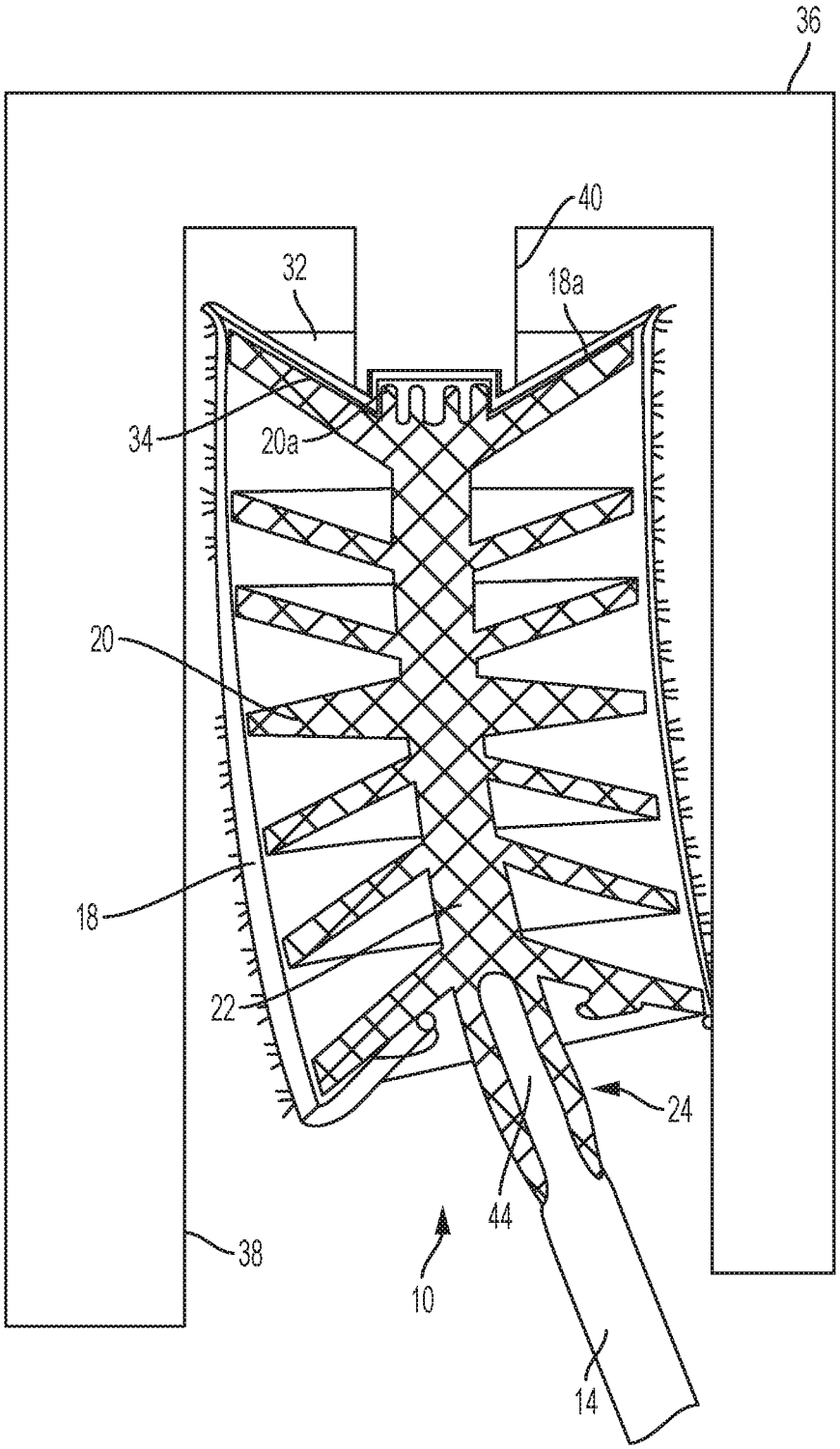
FIG. 4 is a partial sectional view of the cleaning device of FIG. 1 in use.
Figure 5:
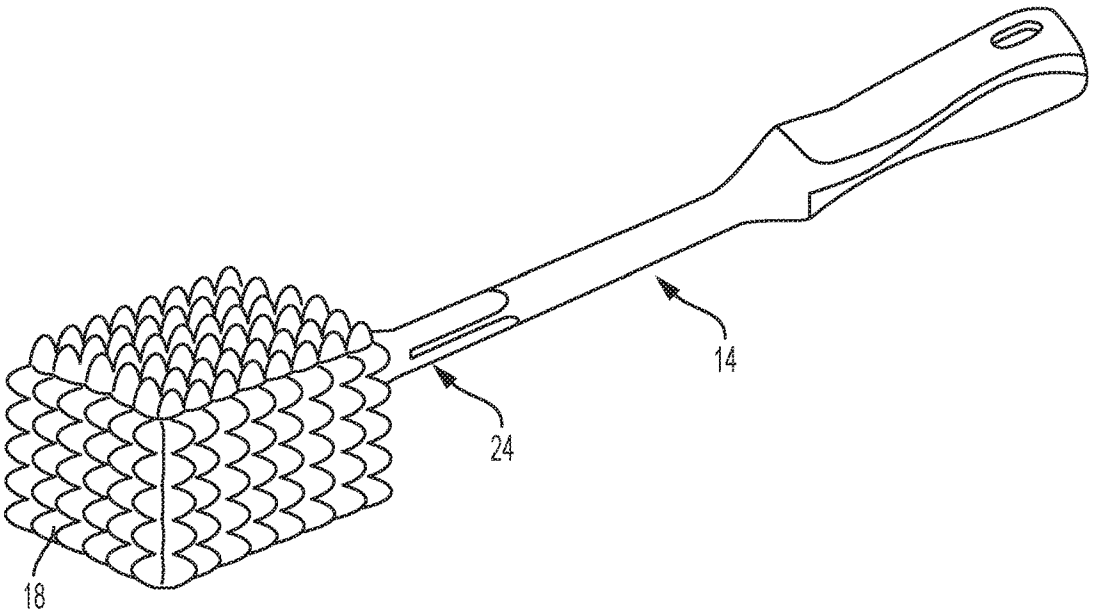
FIGS. 5 and 6 illustrate the cleaning device of FIG. 1 in use with varying cleaning cloths.

Referring to FIG. 4, device 10 is illustrated in use cleaning a beverage dispensing device 36 having a channel 38 and an area 40 at a remote end of the channel. For example, area 40 can be a beverage dispensing nozzle at the and channel 38 can be a beverage dispensing channel such as those present in commercially available beverage machines.

Advantageously, wiper 16 can flex at least at region 24—and in some embodiments at spine 22 and/or ridges 20—allowing handle 14 access into channel 38 while ensuring that open end 32 is aligned with area 40. Open end 32 and internal surface 34 receive area 40 and can clean the area—both its interior and exterior surfaces—with ridges 20*a* and, when present region 18*a* of cloth 18 inside of the open end. Additionally, ridges 20 and, when present, cloth 18 can clean channel 38.

The cleaning effect can occur through rotation about the axis of handle 14, by back and forth movement along the axis, and any combinations thereof. In some embodiments, at least one dimension is—preferably all external dimensions—of wiper 16 substantially correspond to the internal dimensions channel 38 so that wiper 16 ensures contact one or more surfaces—preferably the walls—of the channel.

Here, wiper 16 with cloth 18 thereon can have an outer dimension that is within ±0.25 inches of the internal dimensions of channel 38 so that the cloth simultaneously contacts at least two sides of channel 38, preferably at least three sides of the channel, and most preferably all four sides of the channel.

Additionally, the cleaning effect can occur through contact of cloth 18 and/or region 18*a* with channel 36 and/or area 40 so as to apply a cleaning chemical—such as, but not limited, to a disinfectant, a sanitizer, and others—to the channel and/or area.

In this manner, ridges 20 and/or spine 22 and/or region 24 can resiliently flex to conform wiper 16 to the surface being cleaned—as force is applied to handle 14 to clean difficult to reach and/or uneven surfaces. The multiple flat faces/edges provided by ridges 20 allow the user to rotate and longitudinally translate device 10 to clean surfaces of the area being cleaned.

Wiper 16 is configured to flex in directions perpendicular to the longitudinal axis of handle 14—particularly as a function of flexible region 24 and, in some embodiments, ridges 20 and/or spine 22.

In this manner, device 10 is configured to ensure receipt of area 40 in open end 32 by, for example flexing at region 24 when cleaning implement 12 is inside of channel 36.

Ridges 20 can be designed with different materials and/or thicknesses from one another and/or from the spine 22 and/or region 24 of the spine to create a desired flexion for the intended cleaning task. Further, wiper 16 can include openings 26 formed in the material to enhance flexion in desired areas. Openings 26 can also, in some embodiment, allow for cleaning fluids to drain from wiper 16 as needed.

Wiper 16 is preferably a unitary molded polymer member. In some embodiments, wiper 16 is molded polymer having a Shore A durometer of between 20 and 100, more preferably between 40 and 80. The polymer can include materials such as, but not limited to, silicone, urethane, thermoplastic elastomer (TPE), thermoplastic rubber (TPR), and others.

Wiper 16 can be used alone, or in combination with one or more cleaning cloths 18 such as, but not limited to, disposable cloths (e.g., nonwoven materials), washable textiles (e.g., cotton, polyester, nylon, microfiber, twisted loop microfiber, mesh, and others), and any combinations thereof. Cloth 18 can encase wiper 16 as shown in FIGS. 1-5.

Figure 6:
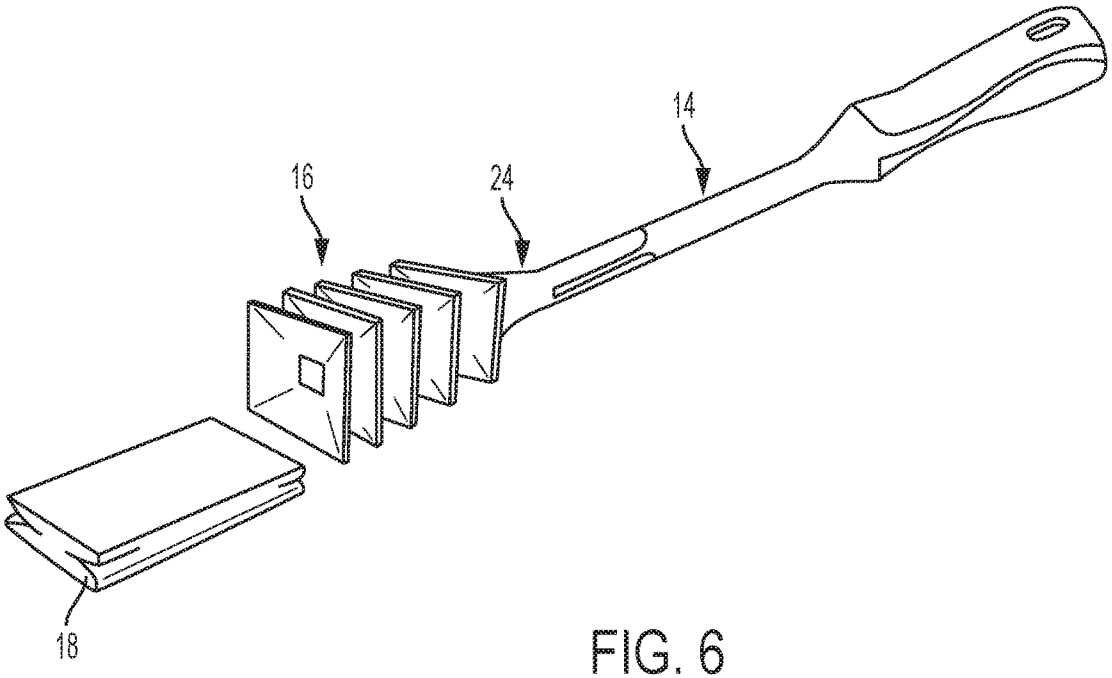

In some embodiments, cloth 18 can be a folded cloth member as in FIG. 6 that can be expanded to encase wiper 16.

In embodiments where wiper 16 is used with cloth 18, device 10 can include one or more connection devices for removably securing the wiper and cloth to one another. For example, wiper 16 can include one or more features 28 that interact with corresponding features 30 on cloth 18. For example, cloth 18 can include features 30 in the form of button holes and/or loops (elastic or inelastic) that can be selectively attached to features 28 on wiper 16.

In other embodiments, the connection devices for securing wiper 16 and cloth 18 can be formed only on the wiper or only on the cloth. In the examples illustrated in FIGS. 7-8 and 9-10, respectively, device 10 is configured with connection devices only on cloth 18.

Figure 7:
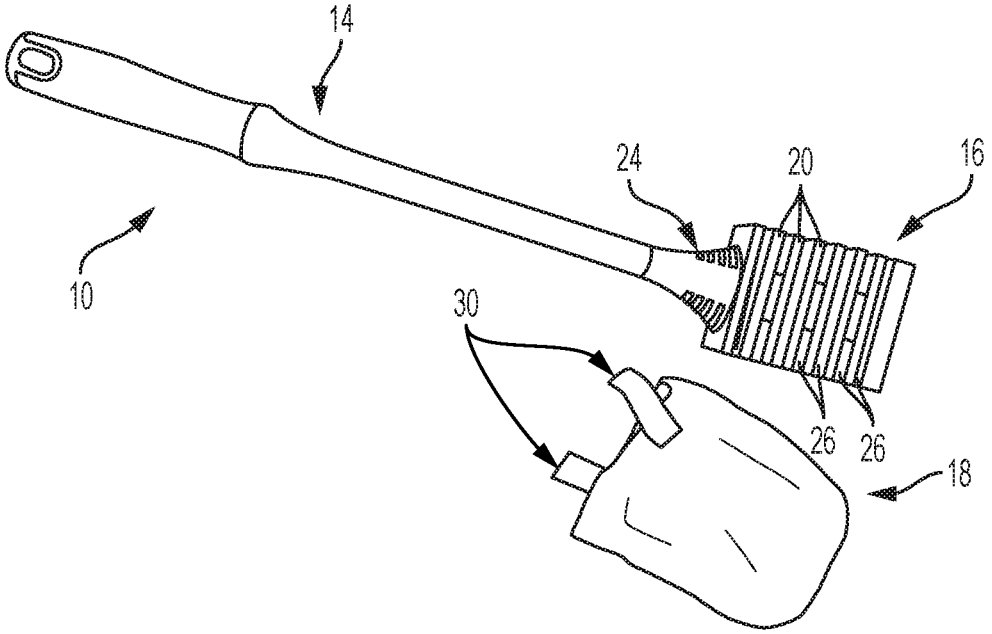
FIGS. 7 and 8 illustrate an exemplary embodiment of the cleaning device of FIG. 1 having an exemplary embodiment of a cleaning cloth before and after installation.
Figure 8:
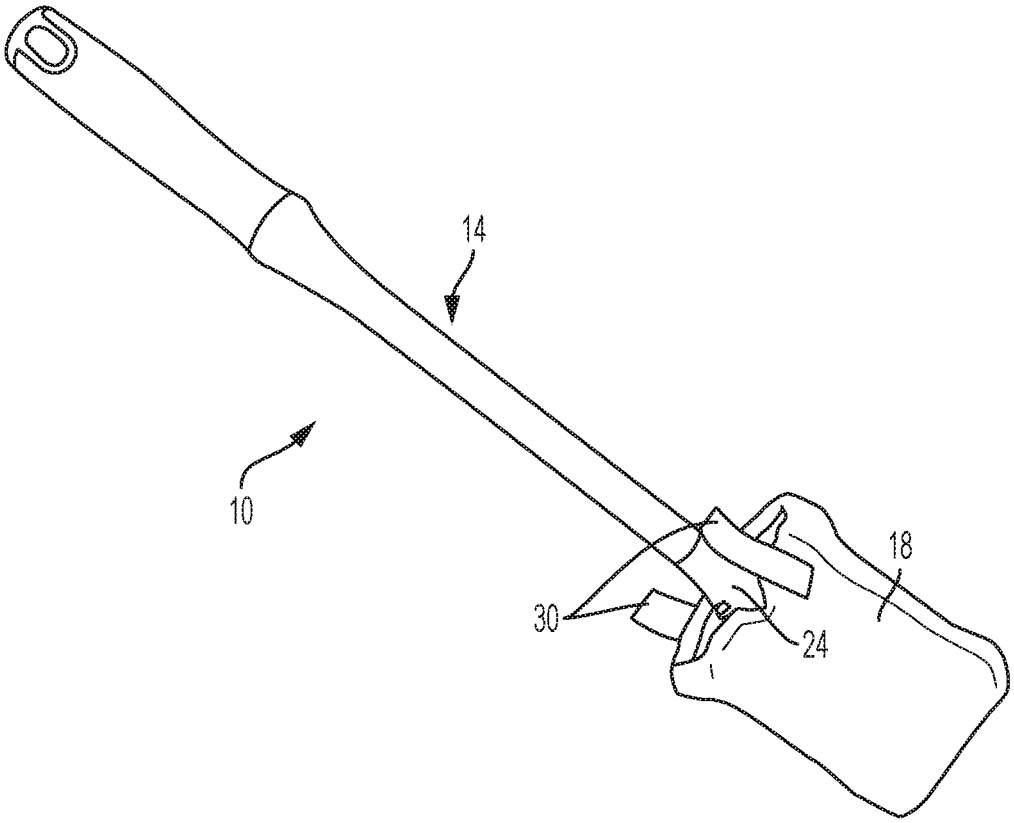

In the embodiment of FIGS. 7-8, cloth 18 includes hook-and-loop (e.g., Velcro) style connections as features 30 that are formed in a direction along the axis of handle 14. Here, cloth 18 is installed on wiper 16 and features 30 are wrapped around a rear end of the wiper.

Figure 9:
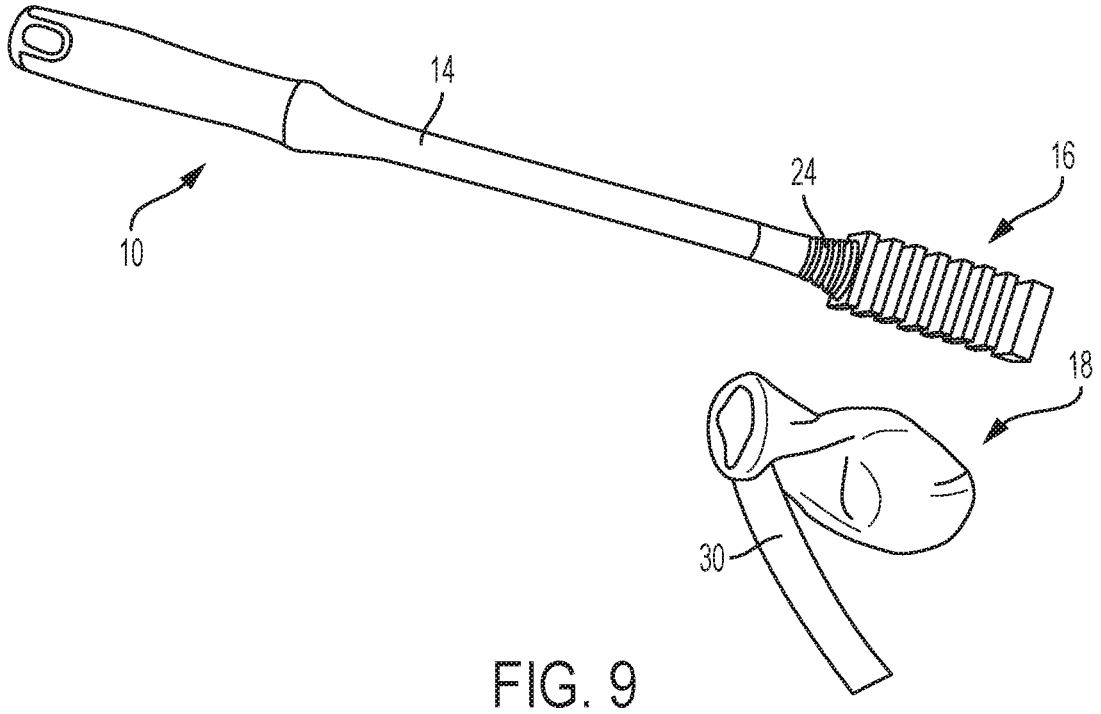
FIGS. 9 and 10 illustrate an exemplary embodiment of the cleaning device of FIG. 1 having another exemplary embodiment of a cleaning cloth before and after installation.
Figure 10:
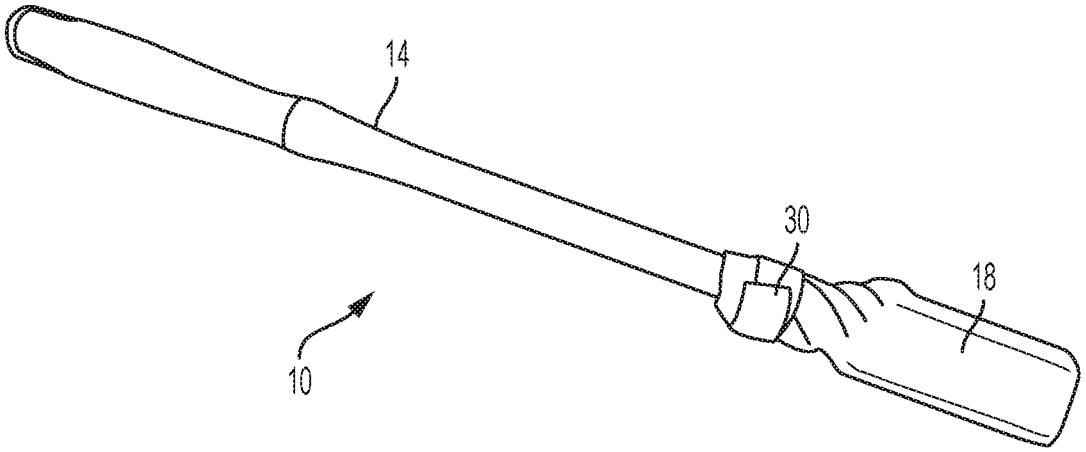
Figure 12:
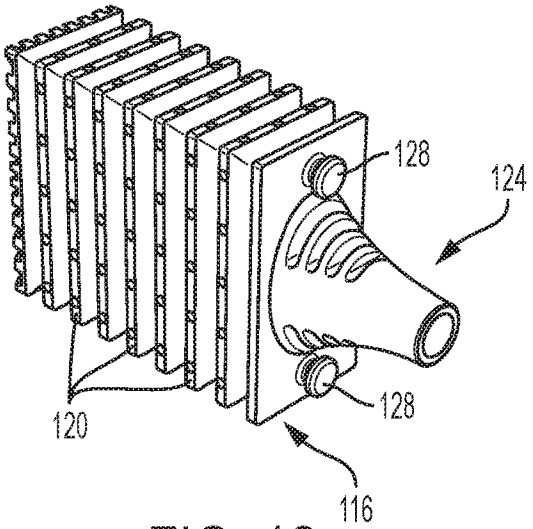
FIG. 12 is a rear perspective view of the wiper of FIG. 11.
Figure 14:
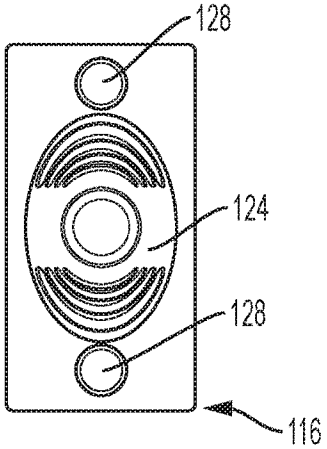
FIG. 14 is an end view of the wiper of FIG. 11.
Figure 11:
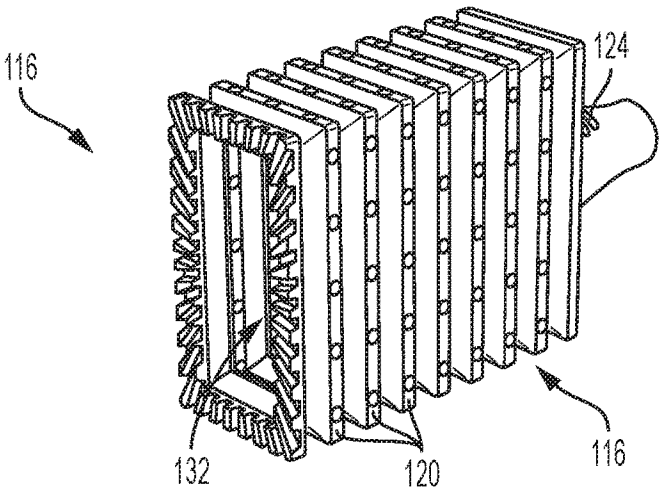
FIG. 11 is a front perspective view of an exemplary embodiment of a wiper for use with the cleaning device according to the present disclosure.
Figure 13:
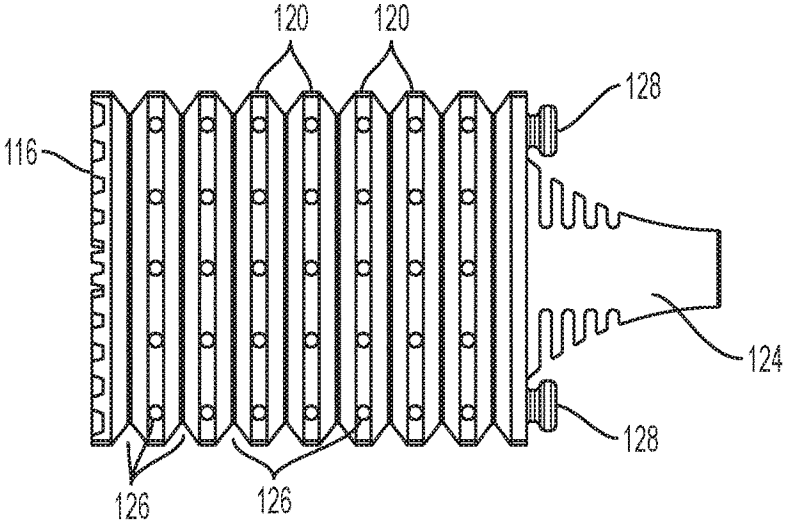
FIG. 13 is a top view of the wiper of FIG. 11.

Alternately in the embodiment of FIGS. 9-10, cloth 18 includes hook-and-loop style connections as features 30 that are formed in a direction perpendicular to the axis of handle 14. Here, cloth 18 is installed on wiper 16 and features 30 are wrapped around handle 14 and/or region 24 of the wiper and secured to itself.

It should be recognized that wiper 16 is illustrated as having a rectangular cross section. However, it is contemplated by the present disclosure for wiper 16 to have any desired cross section such as, but not limited to rectangular, square, round, oval, and others.

Accordingly, device 10 is provided with flexion—of variable levels via region 24 and, when present ridges 20 that also provide cleaning surfaces and/or spine 22—which allow the device to be particularly suited for cleaning hard to reach places.

Referring now to FIGS. 11-15, another exemplary embodiment of a wiper for use with the cleaning device 10 is shown and is referred to by reference numeral 116. Here, component parts performing similar or analogous functions are labeled in multiples of one hundred with respect to wiper 16.

Wiper 116 again has a plurality of ridges 120 that create multiple contact surfaces with the surface being cleaned. Here, ridges 120 are in the form of a hollow member that terminates at a flexible region 124 at one end and has an open end 132.

Wiper 116 is configured to flex in directions perpendicular to the longitudinal axis of handle 14 and to compress and/or elongate along the axis.

In the illustrated embodiment, ridges 120 are illustrated having both a positive angle and a negative angle with respect to a longitudinal axis of handle 114. However, it is contemplated by the present disclosure for ridges 120 to have any desired angle—and for the ridges to all have the same angle or different angles. Additionally, ridges 120 can be configured to flex and/or compress as desired.

Second region 124 is connectable to handle 14 of cleaning device 10 by any desired method such as, but not limited to, mechanical connection, adhesive connection, and others.

Region 124 and, in some embodiments, ridges 120 can resiliently flex to conform wiper 116 to the surface being cleaned—as force is applied to the handle to clean difficult to reach and/or uneven surfaces. Advantageously, the multiple flat faces/edges provided by ridges 120—both external and internal to wiper 116—allow the user to clean the area being cleaned.

Figure 15:
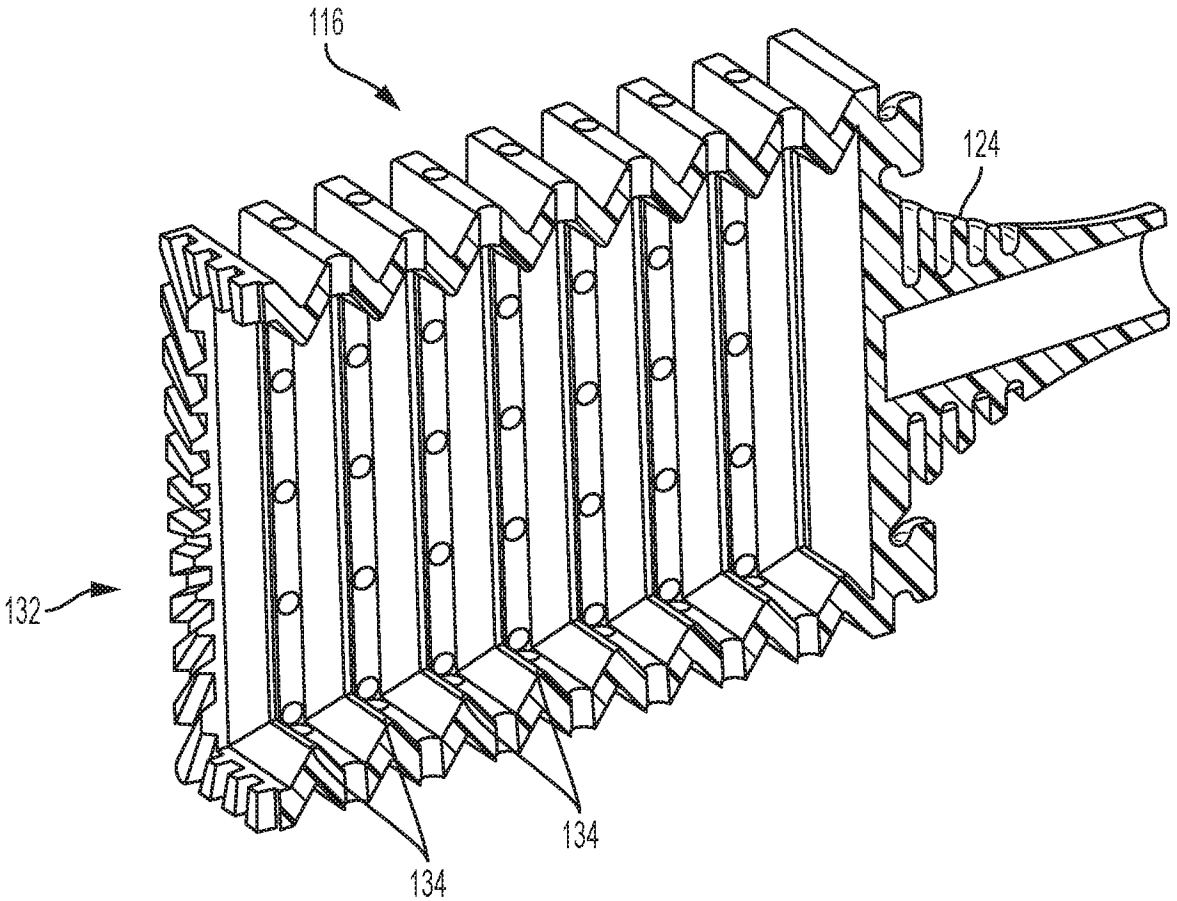
FIG. 15 is a sectional view of the wiper of FIG. 11.
Figure 16:
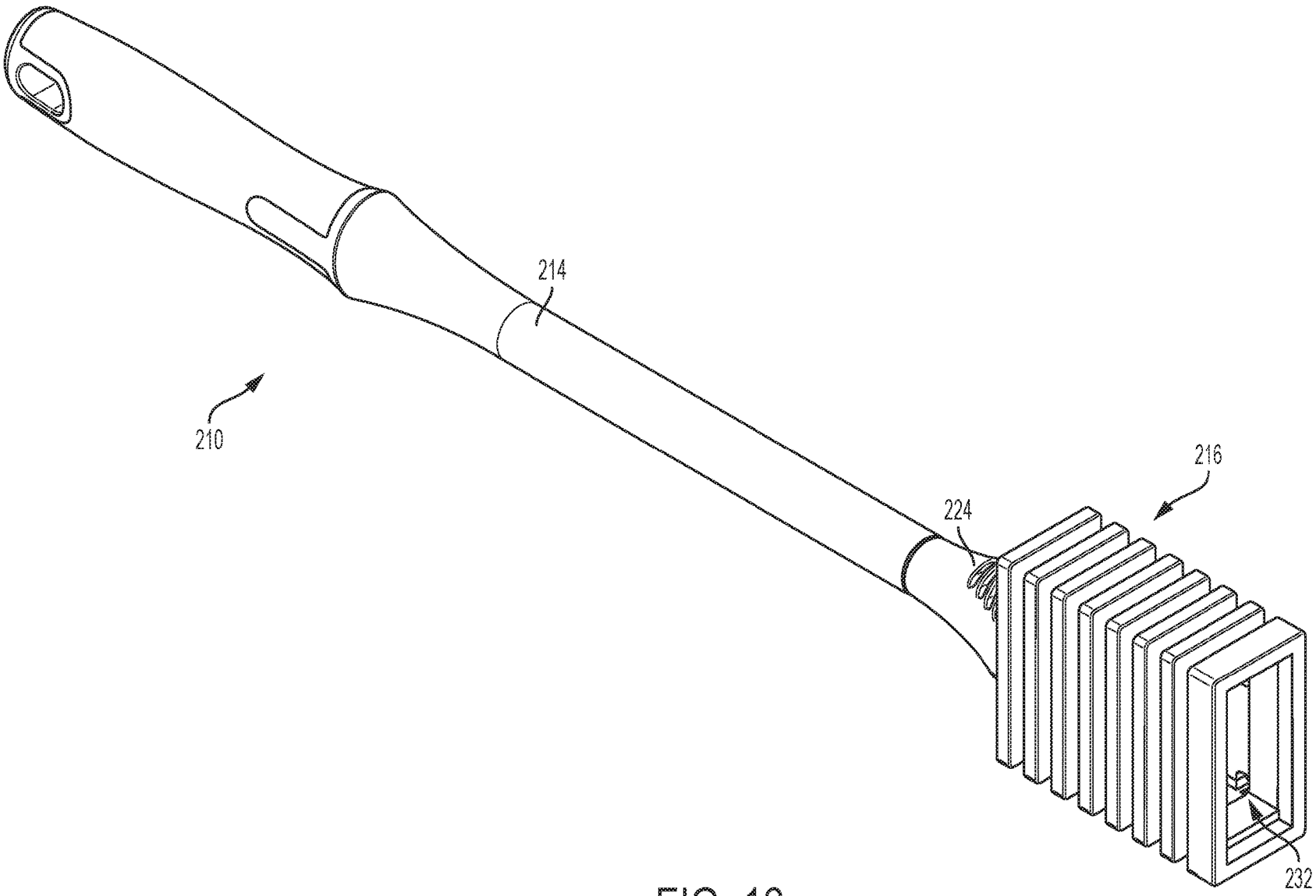
FIG. 16 is a front perspective view of another exemplary embodiment of the cleaning device according to the present disclosure.
Figure 17:
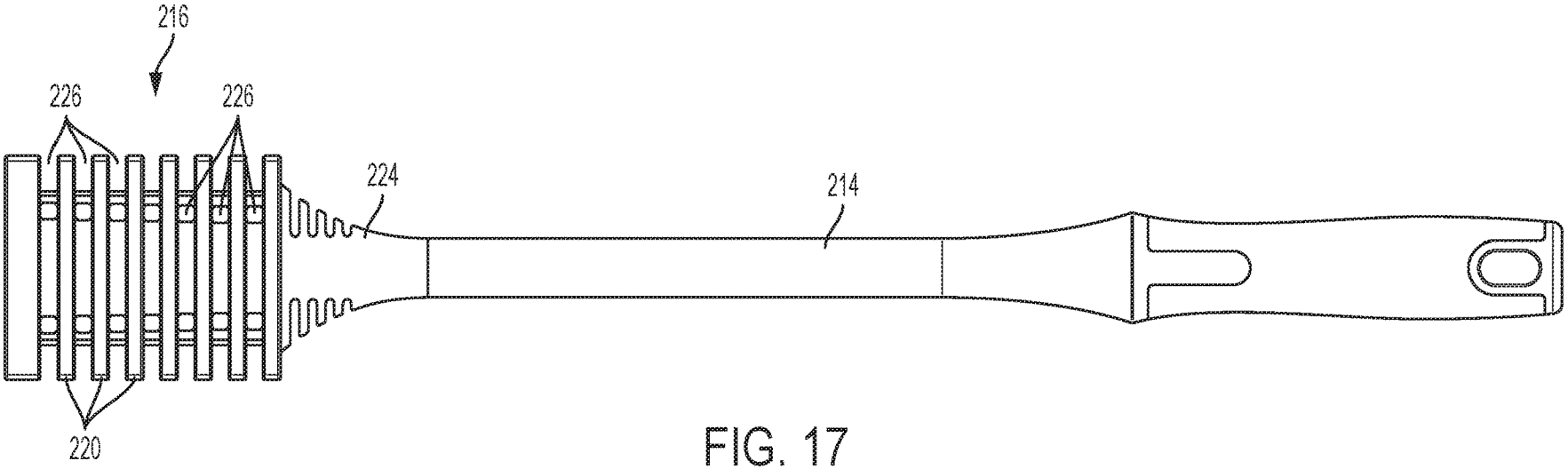
FIG. 17 is a top view of the cleaning device of FIG. 16.
Figure 18:
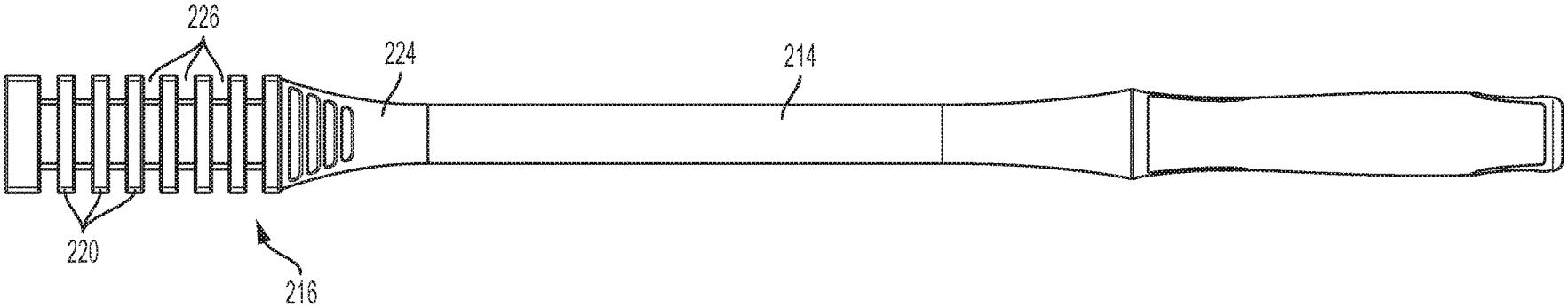
FIG. 18 is a side view of the cleaning device of FIG. 16.
Figure 19:
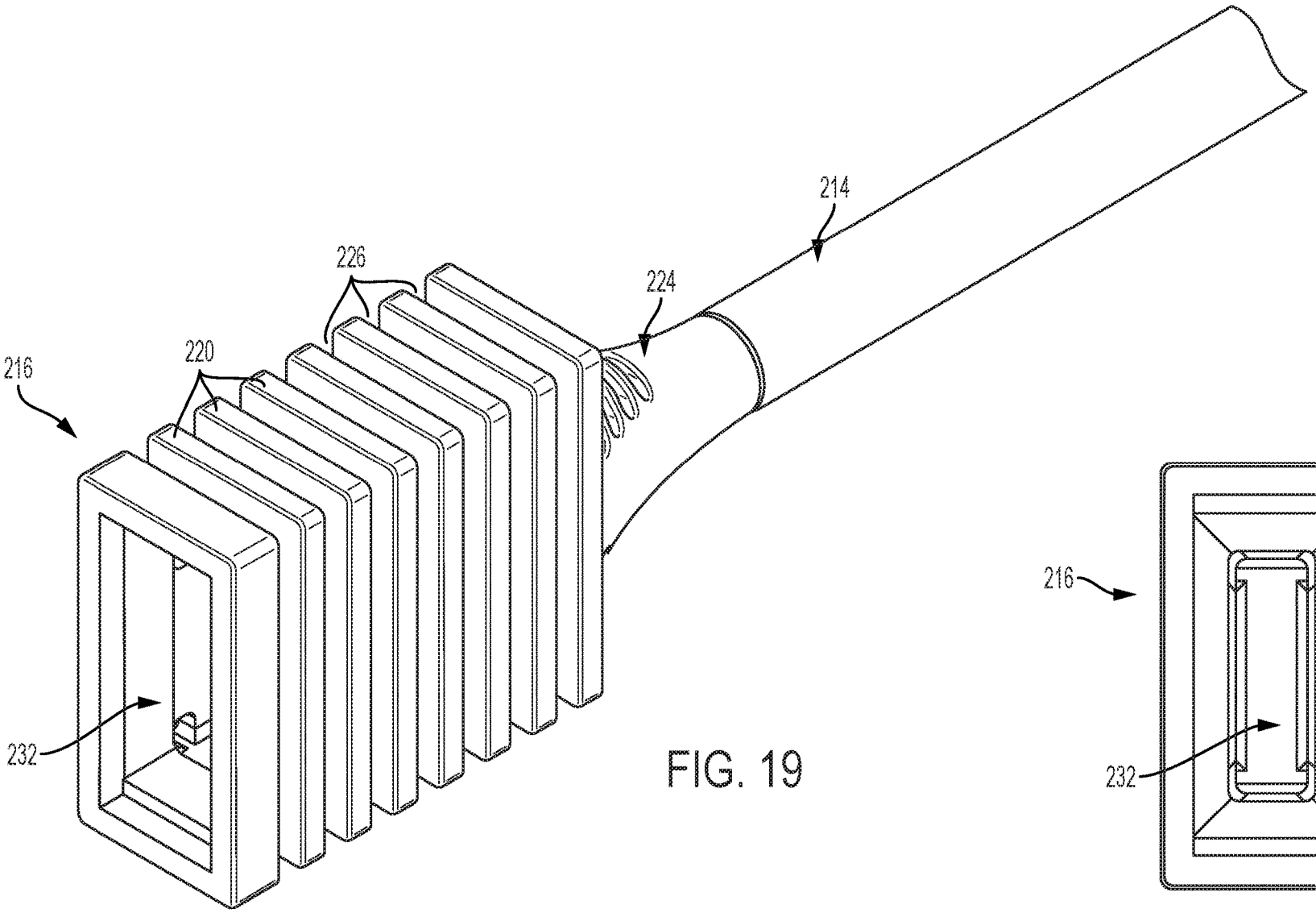
FIG. 19 is a magnified perspective view of the cleaning device of FIG. 16.
Figure 20:
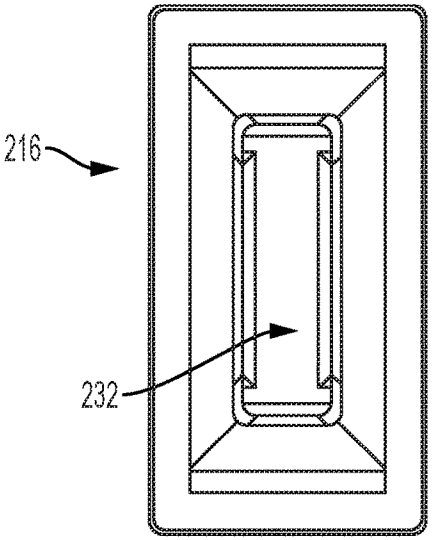
FIG. 20 is an end view of the cleaning device of FIG. 16.
Figure 21:
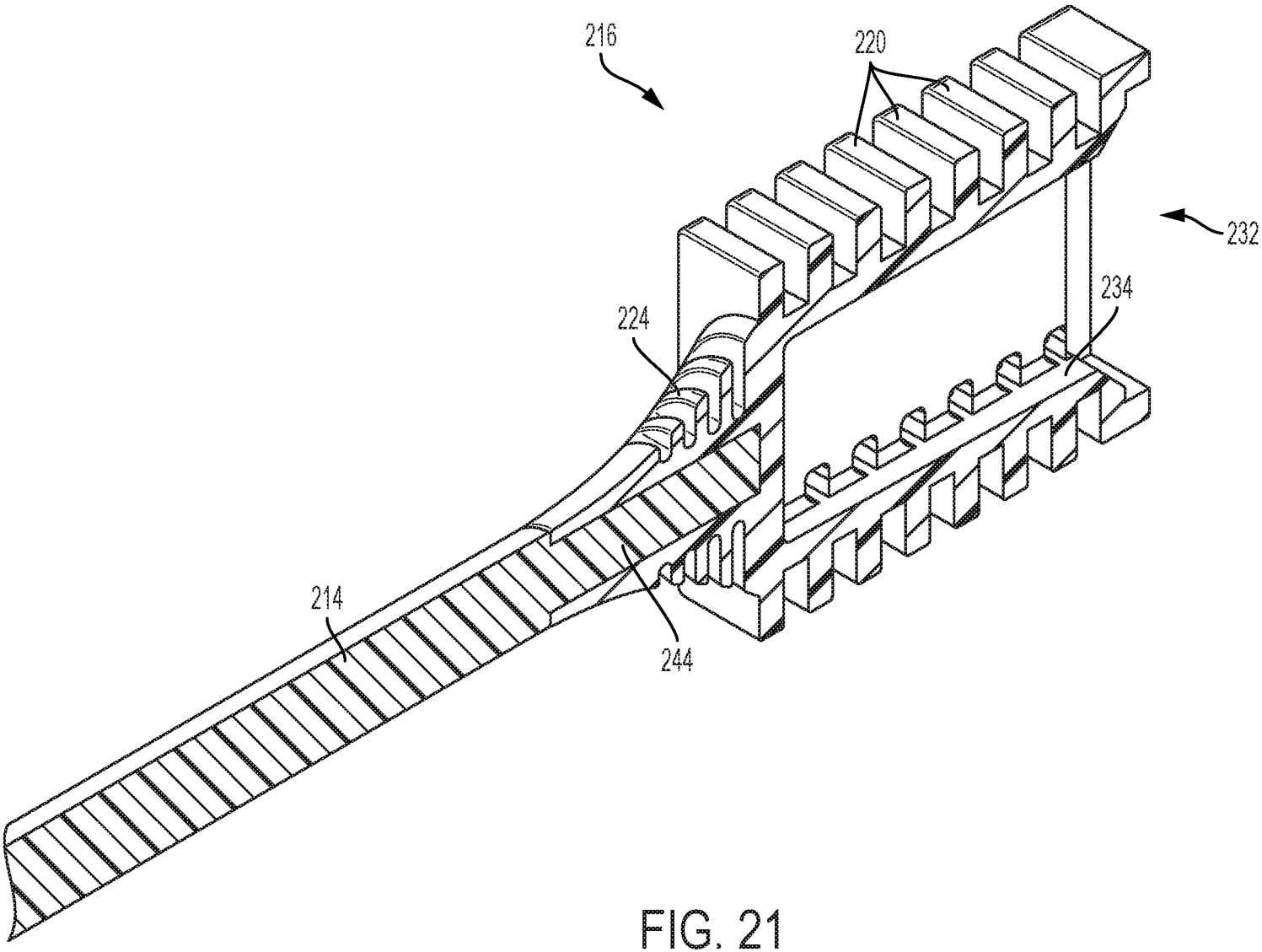
FIG. 21 is a sectional view of the cleaning device of FIG. 16.

Additionally, open end 132 allows wiper 116 to not only use its exterior surface to clean, but also allows access to the internal surfaces 134 of the wiper—namely internal surfaces of ridges 120 as seen in FIG. 15. In this manner, wiper 116 is configured to clean three-dimensional internal surfaces of equipment—such food and/or beverage dispensing equipment.

Ridges 120 can be designed with different materials and/or thicknesses from one another and/or from region 124 to create a desired flexion for the intended cleaning task. Further, wiper 116 can include openings 126 formed in the material to enhance flexion in desired areas.

Wiper 116 is preferably a unitary molded polymer member. In some embodiments, wiper 116 is molded polymer having a Shore A durometer of between 20 and 100, more preferably between 40 and 80. The polymer can include materials such as, but not limited to, silicone, urethane, thermoplastic elastomer (TPE), thermoplastic rubber (TPR), and others.

In embodiments where wiper 116 is used with cloth 18, the wiper can include one or more features 128 that interact with corresponding features 30 on cloth 18 in the manner discussed above.

Referring now to FIGS. 16-25, another exemplary embodiment of cleaning device according to the present disclosure is shown and is referred to by reference numeral 210. Here, component parts performing similar or analogous functions are labeled in multiples of two hundred with respect to device 10.

Device 210 includes a cleaning implement 212 and handle 214. Cleaning implement 212 includes a wiper 216 that, in some embodiments is used in combination with a cleaning cloth 218.

Wiper 216—much like wiper 116 discussed above—has a plurality of ridges 220 that create multiple contact surfaces with the surface being cleaned. In the illustrated embodiment, ridges 220 are illustrated as being perpendicular to a longitudinal axis of handle 214. However, it is contemplated by the present disclosure for ridges 220 to have any desired angle—and for the ridges to all have the same angle or different angles. Additionally, ridges 220 can be configured to flex and/or compress as desired.

Here, ridges 220 are in the form of a hollow member that terminates at a flexible region 224 at one end and has an open end 232.

Region 224, and in some embodiments ridges 220, can resiliently flex to conform wiper 216 to the surfaces being cleaned—as force is applied to the handle to clean difficult to reach and/or uneven surfaces. Advantageously, the multiple flat faces/edges provided by ridges 220 allow the user to clean the area being cleaned.

Wiper 216 is configured in some embodiments to flex at region 224, and in some embodiments at ridges 220, in directions perpendicular to the longitudinal axis of handle 214. In other embodiments, wiper 216 is further configured to compress and/or elongate, at region 224 and/or ridges 220, along the axis. Region 224 is, preferably, molded as a single unitary member with wiper 216 and can be secured to a rib 244 of handle 214.

Additionally, open end 232 allows wiper 216 to not only use its exterior surface to clean, but also allows access to the internal surfaces of the wiper. In this manner, wiper 216 is configured to clean three-dimensional internal surfaces of equipment—such food and/or beverage dispensing equipment.

Figure 25:
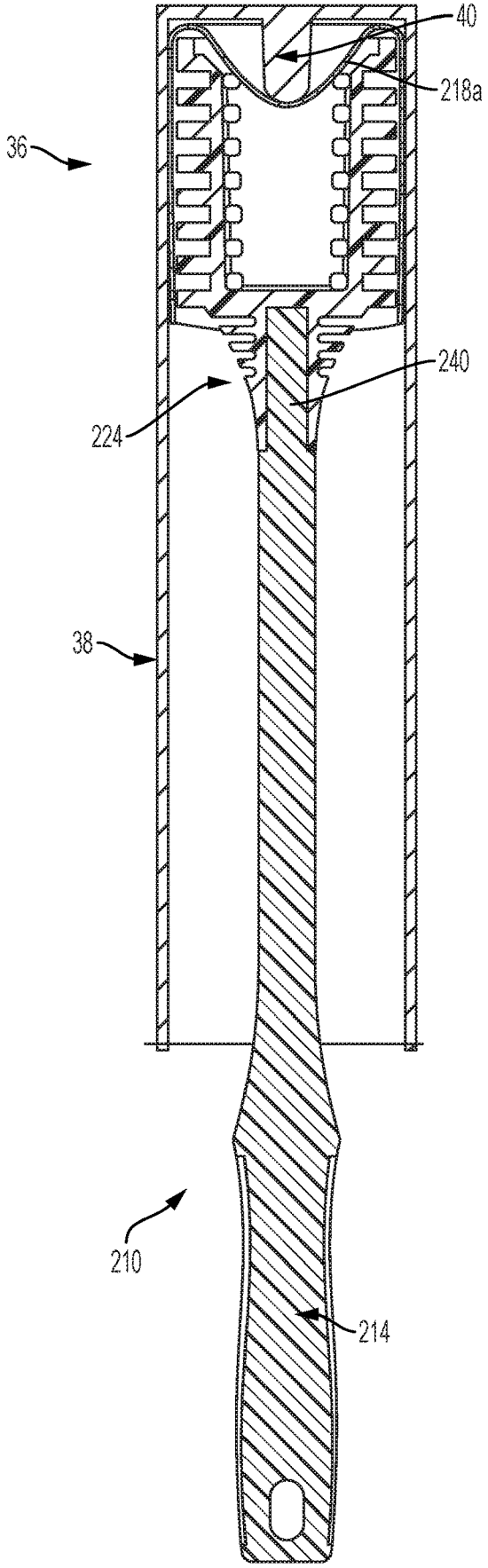
FIG. 25 is a partial sectional view of the cleaning device of FIG. 24 in use.

Referring to FIG. 25, device 210 is illustrated in use cleaning beverage dispensing device 36 having channel 38 and area 40 at a remote end of the channel. Wiper 216 can flex at least at region 224—and in some embodiments at ridges 220—allowing handle 214 access into channel 40 while ensuring that open end 232 is aligned with area 40. Open end 232 and internal surface 234 receive area 40 and can clean the area—both its interior and exterior surfaces—with surface 234 and, when present region **218*a* of cloth 218 inside of the open end. Additionally, ridges 220 and, when present, cloth 218 can clean channel 238. The cleaning effect can occur through rotation about the axis of handle 214, by back and forth movement along the axis, and any combinations thereof. In some embodiments, at least one dimension is—preferably all external dimensions—of wiper 216 corresponds to the internal dimensions channel 38 so that wiper 216, or cloth 218** when present, ensures contact one or more surfaces—preferably the walls—of the channel.

In the illustrated embodiment, wiper 216 has internal surface 234 with a single cleaning face/edge. However, it is contemplated by the present disclosure for internal surface 234 to have any desired number of ridges 220 forming any desired number of faces/edges.

In some embodiments, open end 232 and internal surface 234 are configured to correspond with the external dimensions of a surface being cleaned—either alone or with a portion 218*a* of cloth 218 disposed therein as discussed in more detail below.

Ridges 220 can be designed with different materials and/or thicknesses from one another and/or from region 224 to create a desired flexion for the intended cleaning task. Further, wiper 216 can include openings 226 formed in the material to enhance flexion in desired areas.

Wiper 216 is preferably a unitary molded polymer member. In some embodiments, wiper 216 is molded polymer having a Shore A durometer of between 20 and 100, more preferably between 40 and 80. The polymer can include materials such as, but not limited to, silicone, urethane, thermoplastic elastomer (TPE), thermoplastic rubber (TPR), and others.

Figure 22:
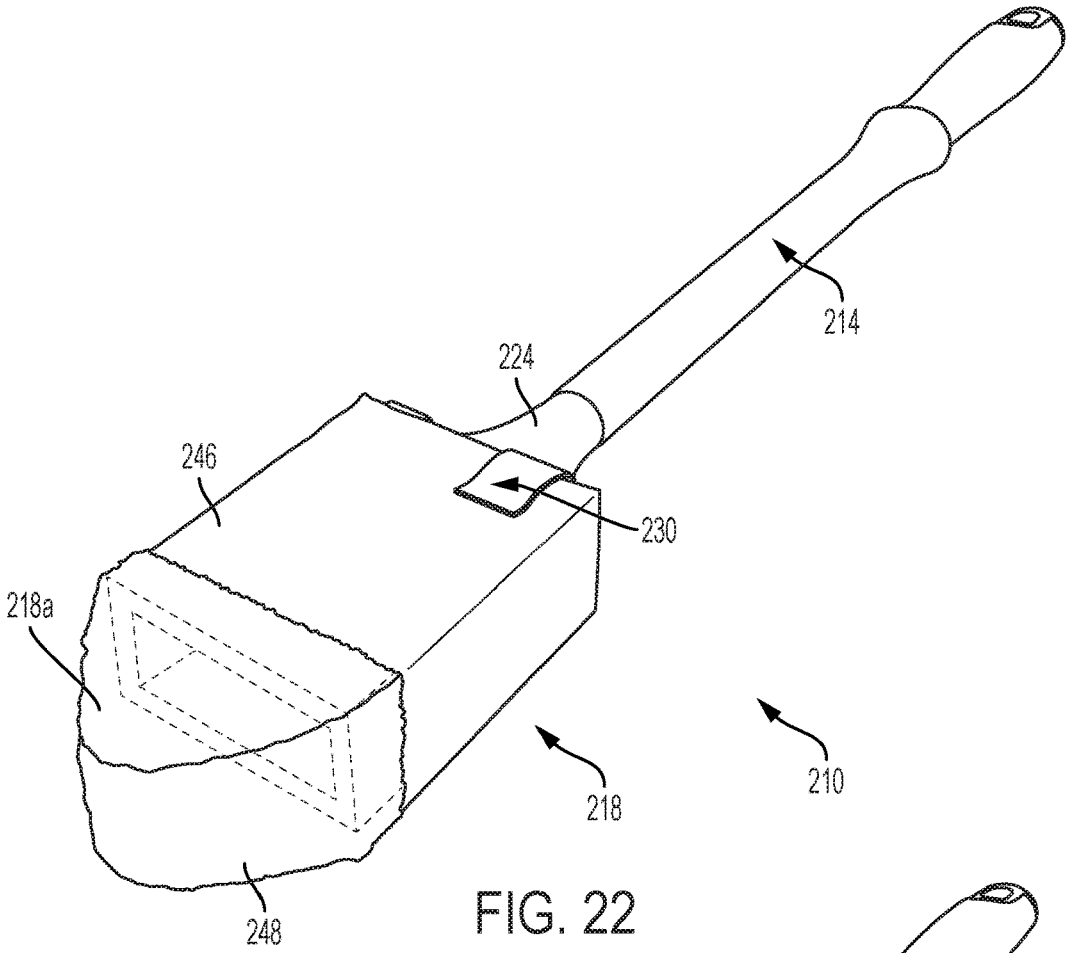
FIGS. 22 and 23 are perspective view of the cleaning device of FIG. 16 having an exemplary embodiment of a cleaning cloth during and after installation.
Figure 23:
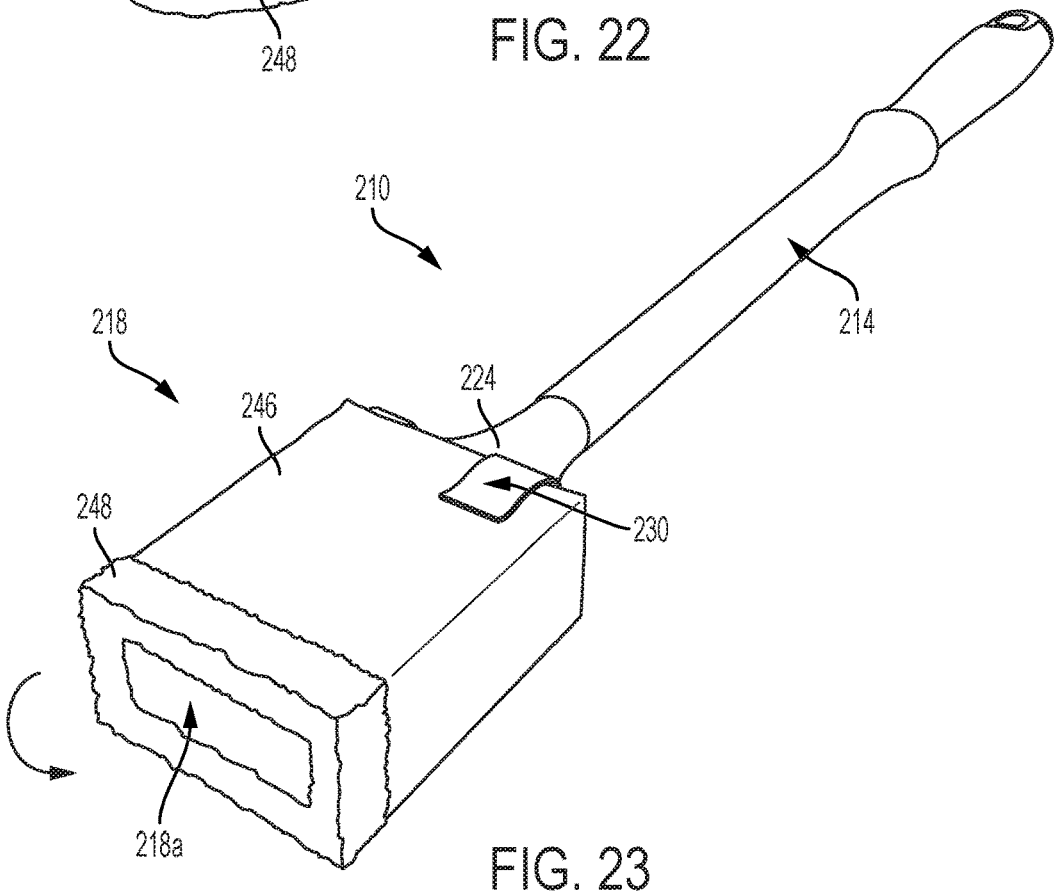
Figure 24:
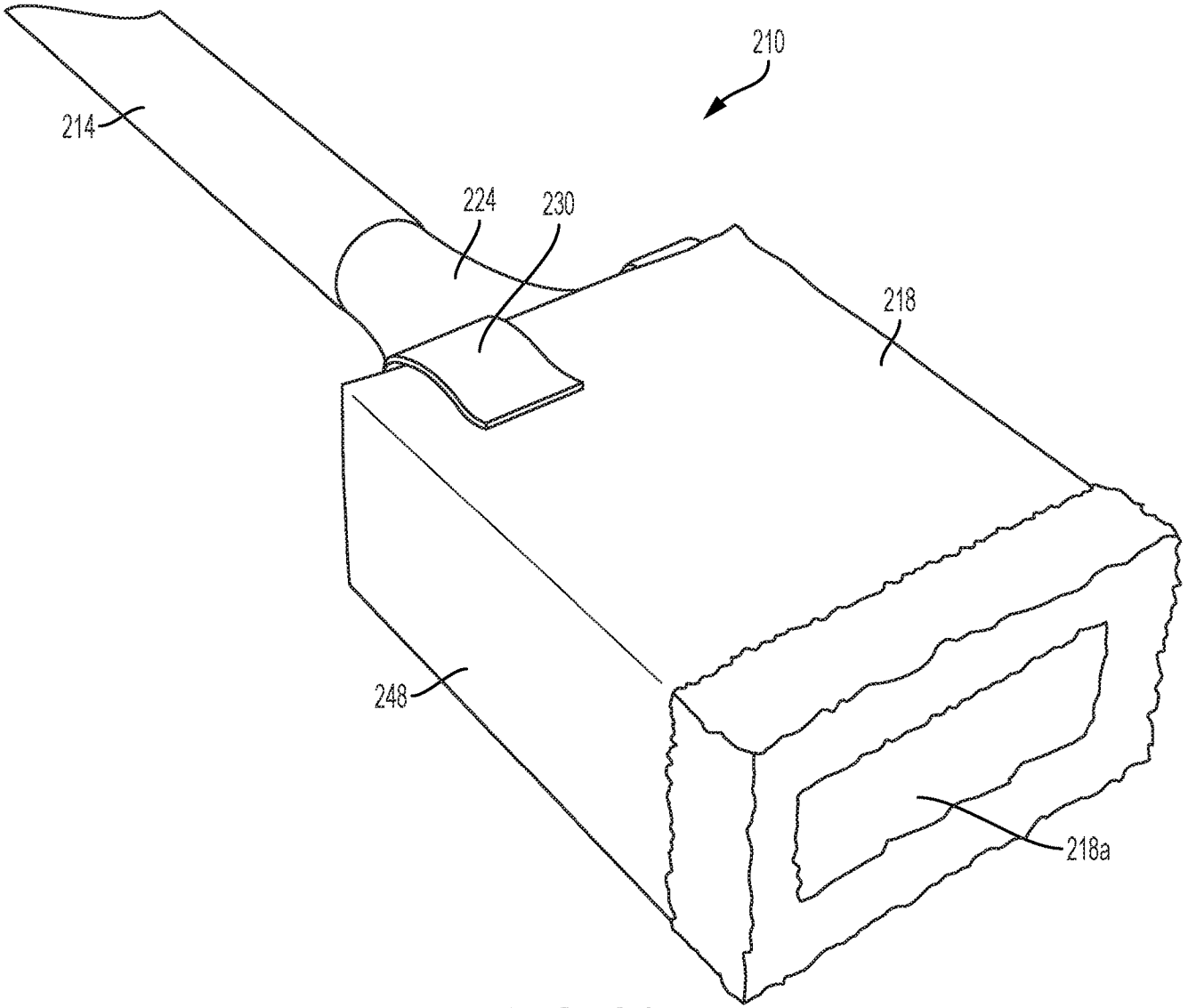
FIG. 24 is a perspective view of the cleaning device of FIG. 16 having another exemplary embodiment of a cleaning cloth disposed thereon.

As shown in FIGS. 22-24, wiper 216 can be used alone, or in combination with one or more cleaning cloths 218 having portions 218*a* that are received in open end 232 of the wiper.

In the embodiment of FIGS. 22-23, cloth 218 includes hook-and-loop style connections as features 230 that are formed in a direction along the axis of handle 214. Here, cloth 218 is installed on wiper 216 and features 230 are wrapped around a rear end of the wiper. Additionally, cloth 218 includes a portion 218*a* that is then tucked inside of wiper 218 via opening 232 (not shown) to cover the internal surfaces.

Cloth 218 is shown in FIGS. 22-23 configured for cleaning only using the internal surfaces of wiper 216. Here, cloth 218 has a mesh 246 on the exterior of wiper 216 and cleaning material 248 in region 218*a*, which is disposed in the interior of the wiper. Advantageously, cloth 218 having mesh 240 on exterior surfaces of wiper ensures that the internal surface carries cleaning chemicals to a desired location without carrying the chemicals to areas in contact with the exterior of the wiper. Moreover, mesh 240 can minimize the amount of cleaning chemicals used by avoiding absorption of the chemicals in unused regions of cloth 218.

Of course, it is contemplated by the present disclosure for cloth 218 to include cleaning material at both the exterior and interior of the wiper as shown in FIG. 24.

In some embodiments, cleaning material 242 on cloth 218—and, when present, region 218*a*, can be made of disposable cloths (e.g., nonwoven materials), washable textiles (e.g., cotton, polyester, nylon, microfiber, twisted loop microfiber, mesh, and others), and any combinations thereof.

It is contemplated by the present disclosure for wiper 16, 116, 216 to have ridges 20, 20*a*, 120, 220 only on the external surfaces, only on internal surfaces, or on combinations of the external and internal surfaces.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A cleaning device for cleaning an article, comprising:

a handle;

a cleaning implement depending from the handle, the cleaning implement comprising a wiper including a plurality of ridges in the form of a hollow member that is resiliently compressible along a longitudinal axis of the handle and has a flexible region at one end for securing the wiper to the handle and an open end at an opposite end, the wiper having an external region including at least one external contact surface and an internal region including at least one internal surface that is accessible via the open end, each of the plurality of ridges being axially spaced along a longitudinal axis of the handle; and a cleaning cloth removably disposed on the wiper, wherein a first portion of the cleaning cloth covers the at least one external contact surface and a second portion of the cleaning cloth covers the at least one internal surface.

2. The cleaning device of claim 1, wherein the plurality of ridges define a plurality of cleaning faces/edges on the internal region.

3. The cleaning device of claim 2, wherein the wiper is flexible and configured so that the plurality of ridges allow the wiper to resiliently flex in directions perpendicular to the longitudinal axis, resiliently elongate in directions along the longitudinal axis, and any combinations thereof.

4. The cleaning device of claim 1, wherein the wiper is formed as a unitary molded polymer member comprising molded silicone or urethane, the material having a Shore A hardness between 20 and 100.

5. The cleaning device of claim 1, wherein the cleaning cloth comprises a cleaning material at both the exterior and interior regions.

6. The cleaning device of claim 1, wherein the cleaning cloth comprises a mesh at the exterior region and a cleaning material at the interior region.

7. The cleaning device of claim 1, each of the plurality of ridges has a substantially identical configuration.

8. The cleaning device of claim 1, wherein at least one external surface of each of the plurality of ridges is arranged at an angle relative to the longitudinal axis of the handle.

9. The cleaning device of claim 8, wherein at least one of the plurality of external surfaces of each of the plurality of ridges is arranged at a positive angle relative to the longitudinal axis of the handle and at least one of the plurality of external surfaces of each of the plurality of ridges is arranged at a negative angle relative to the longitudinal axis of the handle.

* * * * *